US009617061B2

(12) United States Patent
Räsänen et al.

(10) Patent No.: US 9,617,061 B2
(45) Date of Patent: Apr. 11, 2017

(54) CUP PACKAGE OF A FIBROUS MATERIAL AND A METHOD OF MANUFACTURING THE SAME

(75) Inventors: Jari Räsänen, Imatra (FI); Niilo Pöyhönen, Lappeenranta (FI); Jarmo Bergholm, Hämeenlinna (FI)

(73) Assignee: STORA ENSO OYJ, Helsinki (FI)

( * ) Notice: Subject to any disclaimer, the term of this patent is extended or adjusted under 35 U.S.C. 154(b) by 964 days.

(21) Appl. No.: 10/587,503

(22) PCT Filed: Feb. 15, 2005

(86) PCT No.: PCT/FI2005/000099

§ 371 (c)(1),
(2), (4) Date: Jan. 30, 2007

(87) PCT Pub. No.: WO2005/077768

PCT Pub. Date: Aug. 25, 2005

(65) Prior Publication Data

US 2007/0170236 A1 Jul. 26, 2007

(30) Foreign Application Priority Data

Feb. 16, 2004 (FI) ..... 20040242

(51) Int. Cl.
*B65D 81/32* (2006.01)
*B65D 43/02* (2006.01)

(52) U.S. Cl.
CPC ..... *B65D 81/3216* (2013.01); *B65D 43/022* (2013.01); *B65D 2543/0024* (2013.01);
(Continued)

(58) Field of Classification Search
CPC ..... B65D 81/3216; B65D 43/022; B65D 2543/00509; B65D 2543/00268;
(Continued)

(56) References Cited

U.S. PATENT DOCUMENTS 2,002,458 A * 5/1935 Sebell ..... 220/801
2,074,639 A * 3/1937 Burdick ..... 220/8
(Continued)

FOREIGN PATENT DOCUMENTS

DE 7833884 U1 2/1979
EP 0 475 690 A1 3/1992
(Continued)

OTHER PUBLICATIONS

Machine translation of FR 811,957.*
(Continued)

*Primary Examiner* — Stephen Castellano

(74) *Attorney, Agent, or Firm* — Birch, Stewart, Kolasch & Birch, LLP

(57) ABSTRACT

The invention relates to a cup package made of a fiber-based material and to a method for manufacturing it. The package comprises a cup 1 for the product 9 to be packaged and a lid 2 for closing the cup mouth. In accordance with the invention, the lid is partially nested in the cup, the adhesion between the inner surface of the cup and the lid retaining the lid in position. Adjacent beads, such as mouth rolls 5, 8 have been formed at the mouth of the cup and the edge of the lid, the beads acting as solder bases for the user's fingers/when the package is opened. The lid can be formed by connecting a discoid centre 6 and a surrounding frame 7 and by equipping the frame with a mouth roll by a technique corresponding to the manufacture of a cup formed of a bottom 4 and a mantle 3 connected to this.

18 Claims, 4 Drawing Sheets

Figure 1:
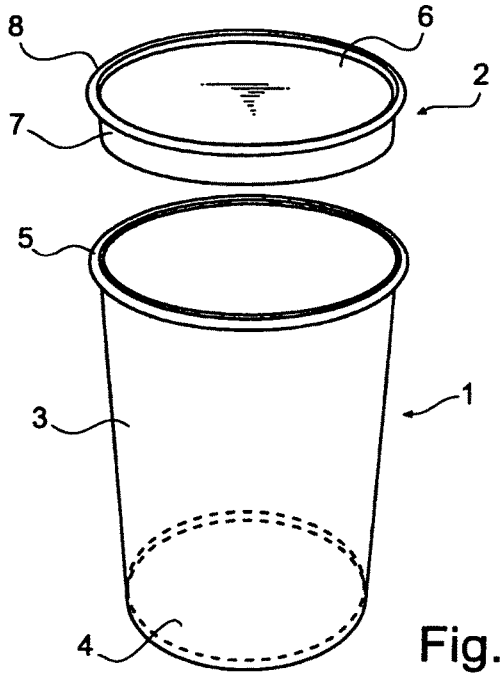

(52) U.S. Cl.
CPC ..... *B65D 2543/00092* (2013.01); *B65D 2543/00268* (2013.01); *B65D 2543/00509* (2013.01); *B65D 2543/00546* (2013.01); *B65D 2543/00907* (2013.01)

(58) Field of Classification Search
CPC ..... B65D 2543/00907; B65D 2543/00092; B65D 2543/00222; B65D 2543/0075; B65D 2543/0024; B65D 2543/00546
USPC ..... 220/23.87, 23.89, 496, 801, 802, 800; 229/125.09, 400, 404; 493/109, 459
See application file for complete search history.

(56) References Cited

U.S. PATENT DOCUMENTS

| | | | | |
|---|---|---|---|---|
| 2,756,921 | A * | 7/1956 | Sternau | 229/404 |
| 2,922,563 | A * | 1/1960 | Aldington | 206/508 |
| 2,985,354 | A * | 5/1961 | Aldington | 229/404 |
| 2,993,636 | A * | 7/1961 | Aldington | 229/404 |
| 3,104,045 | A * | 9/1963 | Sheninger et al. | 229/125.26 |
| 3,144,971 | A * | 8/1964 | Wommelsdorf | 229/400 |
| 3,349,941 | A | 10/1967 | Wanderer | |
| 3,420,397 | A * | 1/1969 | Miller | 220/203.09 |
| 3,613,940 | A * | 10/1971 | Davis | 220/781 |
| 3,620,437 | A * | 11/1971 | Kulp | 229/404 |
| 3,648,888 | A * | 3/1972 | Cheladze | 206/519 |
| 3,814,277 | A * | 6/1974 | La Croce et al. | 220/801 |
| 3,893,567 | A * | 7/1975 | Davis et al. | 206/520 |
| 4,280,652 | A * | 7/1981 | Schmidt | 229/125.17 |
| 4,429,825 | A | 2/1984 | Kipp | |
| 4,452,596 | A | 6/1984 | Clauss et al. | |
| 4,583,680 | A * | 4/1986 | Gordon et al. | 229/125.28 |
| 4,934,591 | A | 6/1990 | Bantleon | |
| 5,029,749 | A | 7/1991 | Aloisi | |
| 5,385,255 | A * | 1/1995 | Varano et al. | 229/404 |
| 5,431,619 | A * | 7/1995 | Bacon et al. | 493/158 |
| 5,490,827 | A * | 2/1996 | Van de Geijn et al. | 493/109 |
| 6,136,396 | A * | 10/2000 | Gilmer | 428/36.5 |
| 7,510,514 | B2 * | 3/2009 | Messerschmid et al. | 493/155 |
| 2004/0155048 | A1 * | 8/2004 | R. Aiken | 220/801 |
| 2007/0170236 | A1 * | 7/2007 | Rasanen et al. | 229/404 |
| 2007/0181591 | A1 * | 8/2007 | Pierce et al. | 220/801 |
| 2007/0181659 | A1 * | 8/2007 | Rasanen et al. | 229/404 |
| 2008/0029525 | A1 * | 2/2008 | Rasanen et al. | 220/658 |

FOREIGN PATENT DOCUMENTS

| | | | |
|---|---|---|---|
| FI | 1755/71 | A | 12/1971 |
| FI | 924822 | A | 5/1993 |
| FR | 811957 | A | 4/1937 |
| GB | 191400221 | A | 0/1914 |
| GB | 191100947 | | 12/1911 |
| GB | 617503 | A | 2/1949 |
| JP | 29-7564 | B | 7/1954 |
| JP | 40-16450 | B2 | 6/1965 |
| JP | 47-217 | Y1 | 1/1972 |
| JP | 50-47801 | U | 4/1975 |
| JP | 52-144932 | U | 11/1977 |
| JP | 59-175057 | U | 11/1984 |
| JP | 1-124570 | A | 5/1989 |
| JP | 4-84151 | U | 7/1992 |
| JP | 5-65818 | U | 8/1993 |
| JP | 7-40472 | A | 2/1995 |
| JP | 2001139062 | | 5/2001 |
| JP | 3080882 | U | 7/2001 |
| WO | WO-03/101855 | A1 | 12/2003 |

OTHER PUBLICATIONS

Office Action dated Dec. 1, 2010 for Japanese Application No. 2006-552644.

Japanese Office Action of Japanese Application No. 2006-552644 dated Aug. 31, 2011 with English translation.

Japanese Office Action, dated Jun. 26, 2013, for Japanese Application No. 2012-17246 with an English translation.

* cited by examiner

CUP PACKAGE OF A FIBROUS MATERIAL AND A METHOD OF MANUFACTURING THE SAME

This application is the national stage (Rule 371) of international application No. PCT/FI05/00099.

The invention relates to a cup package made of a fibre-based material comprising a cup for a product to be packaged and a lid for closing the cup mouth. The invention also relates to a method for manufacturing such a cup package.

Fibre-based materials, i.e. plastic-coated packaging board, are used in mass-scale production of disposable drinking cups. The conical cups are delivered for use piled in nested relationship and do not hence require a lid for closing the cup.

Board cups are also used in disposable packages for e.g. milk, yoghurt, juices and desserts, and are then equipped with a heat-sealable tear-off lid. The lid material is suitably aluminium or plastic-coated paper or board. Once they have been opened, such packages cannot be closed.

Ice cream is delivered in single packages consisting of board cups whose lids, which are also made of board, are retained in position by adhesion between the lid and the ice cream. These packages are not either intended to be closed anew.

Openable and closable cup or container packages made of board are used for jam, marmalade or similar foodstuffs dispensed in small amounts. Usually the lids of such consumer board packages are made of plastic.

The purpose of the invention is to provide a cup package with a lid that can be readily opened and closed and in which both the cup and the lid are made of a fibre-based material, such as packaging board. The solution of the invention consists of a package which is characterised by the lid being partially nested in the cup, the adhesion between the inner surface of the cup and the lid retaining the lid in position, with adjacent beads provided at the cup mouth and the edge of the lid to serve as grip bases when the lid is opened.

The purpose of the bead disposed at the edge of the lid, which can be produced by mechanical moulding by folding or winding the lid material, is to stiffen the lid, giving it resistance to slight compression as the user grips the lid and lifts or tears it off the cup mouth or presses it back in position in order to seal the cup mouth. At the same time, the stiff bead acts as a stop for the user's fingers, providing a base for a firm grip, thus ensuring, together with the corresponding bead, easy opening and closing of the package.

A bead, such as a mouth roll, formed at the cup mouth, belongs to techniques known per se regarding disposable board cups. A mouth roll is manufactured at the final stage of the cup production by bending and/or pressing the board at the cup mouth by means of a moulding tool with utilisation of heat and any adjuvants and humidification of the board. A mouth roll is required for stiffening the cup and it also gives the user the desired sensation in the mouth when drinking from the cup. In this respect, the invention has the central feature of the corresponding mouth roll or like bead being formed also in the lid closing the cup mouth. The cup and the lid can be made from the same fibre-based material, such as plastic-coated, water-repellent or water vapour-proof packaging board, and the beads, such as mouth rolls formed in these, can be produced by the same techniques and have mutually corresponding designs.

The mantle and the lid of the cup can expand conically upwards, with their conical surfaces adhering to each other in opposite relationship when the lid is in position. The conical cup corresponds to conventional drinking cups made of board, and in connection with the invention, the conical design has the additional advantage of providing particularly easy removal of the lid and especially restitution of the lid at the mouth of the cup.

Attachment of the lid and its retention at the mouth of the cup may be based merely on friction and compression between the inner surface of the cup and the lid. In many cases, this provides sufficient seal. However, when necessary, the attachment of the lid can be enhanced by means of beads formed on the opposite adhesion surfaces of the cup and the lid or possibly interlocking beads and engagements.

In a preferred embodiment of the invention, the package lid is formed by a combination of a principally discoid centre and a surrounding frame bearing against the inner surface of the cup, the frame having a mouth roll or any like bead at its edge. This means that the cup and the lid may have mutually corresponding basic designs. The lid centre matches the bottom of the cup and the lid frame matches the cup mantle, with the sole difference of the dimensioning of the parts; for the package to get volume, the cup mantle must have sufficient height, whereas the lid frame appropriately has a low height.

The package of the invention can further be applied in such a manner that the package has at least three parts, comprising a lower-most larger-sized cup, a smaller-sized cup partially nested in this and an uppermost lid, each of said parts comprising a mouth roll or like bead, with vertically adjacent beads serving as grip bases when the parts are detached from each other. In such a package, cups of varying volumes placed on top of each other may also have varying contents. One can, for instance, form a food package in which the lower larger-sized cup contains the main product and the upper smaller-sized cup contains trimmings to be used with this, such as seasoning or dressing. The upper cup has not only the function of forming one of the package sections but also to act as a lid for the lower cup. The mouth rolls or like beads on the package sides enable the package to be opened by sections at the user's choice. The lower cup can be opened by detaching the upper cup from it, the upper cup remaining closed with a lid. The upper cup, again can be opened by releasing its lid and by separating the upper cup from the lower one, which remains closed. Of course, all the cups are opened when all of the parts of the package are separated. Accordingly, a separated package can be assembled by connecting its parts in the desired order.

The method of the invention for producing a cup package with a lid relates specifically to a package application in which the cup and the lid have the same two-part basic design. The method is characterised by forming a cup by connecting a principally discoid bottom with the mantle forming the cup sides and by equipping the cup mouth with a surrounding bead, and by forming a lid for closing the cup mouth by connecting the principally discoid centre with a frame partially nested in the cup mantle, and by equipping the edge of the frame with an encircling bead, the cup and the lid being substantially manufactured by mutually corresponding operations, the beads formed in the cup and the lid, in adjacent relationship in the sealed package, serving as grip bases when the package is opened.

Figure 2:
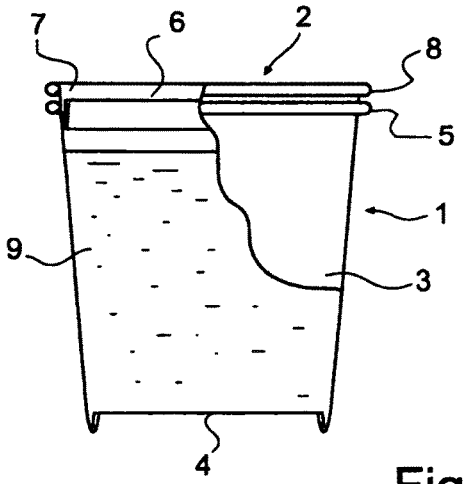
Figure 3:
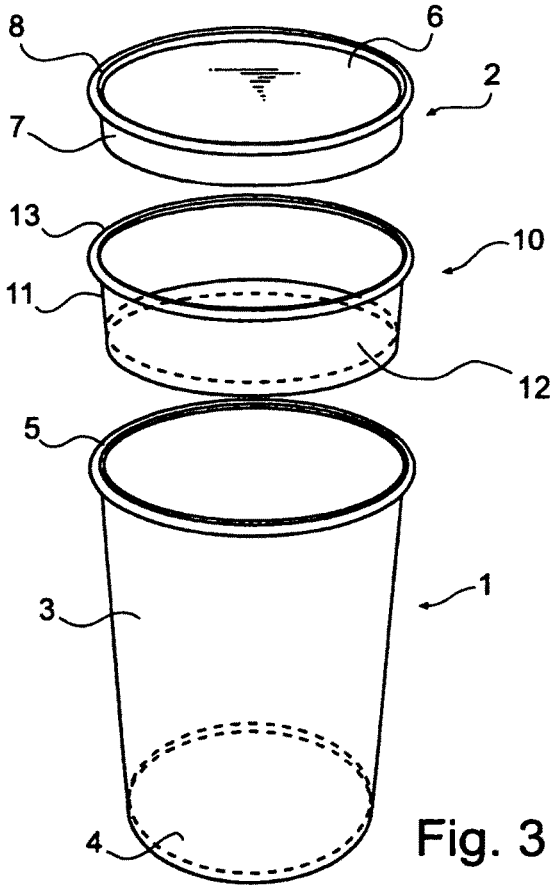
Figure 4:
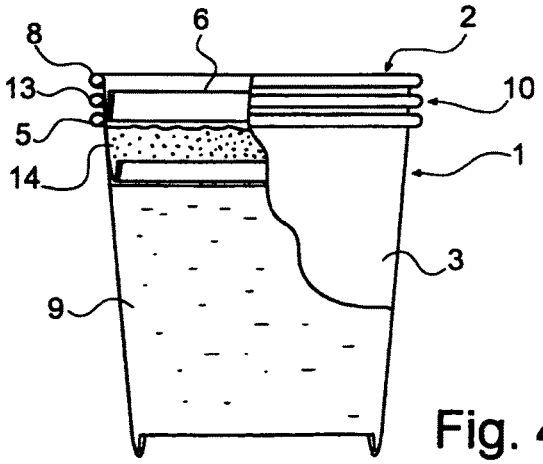
Figure 5:
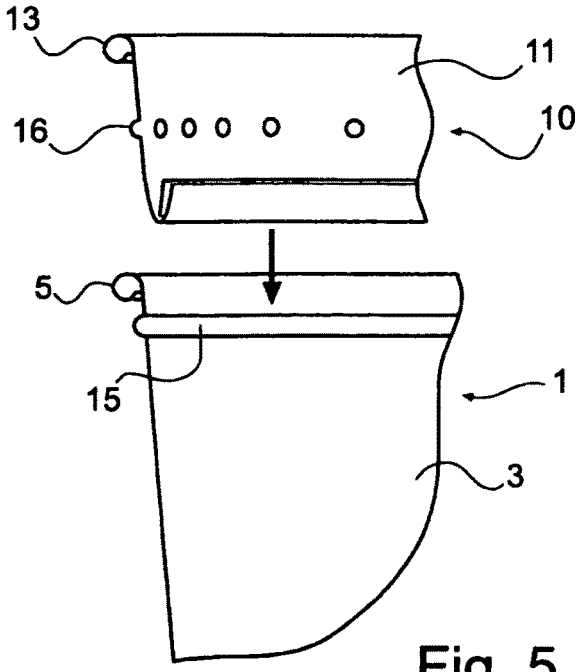
Figure 6:
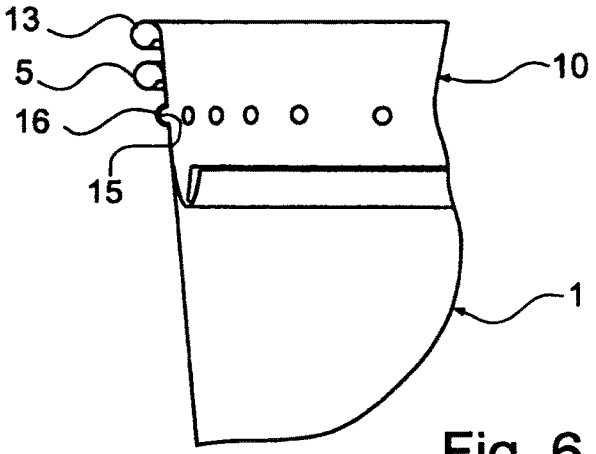
Figure 7:
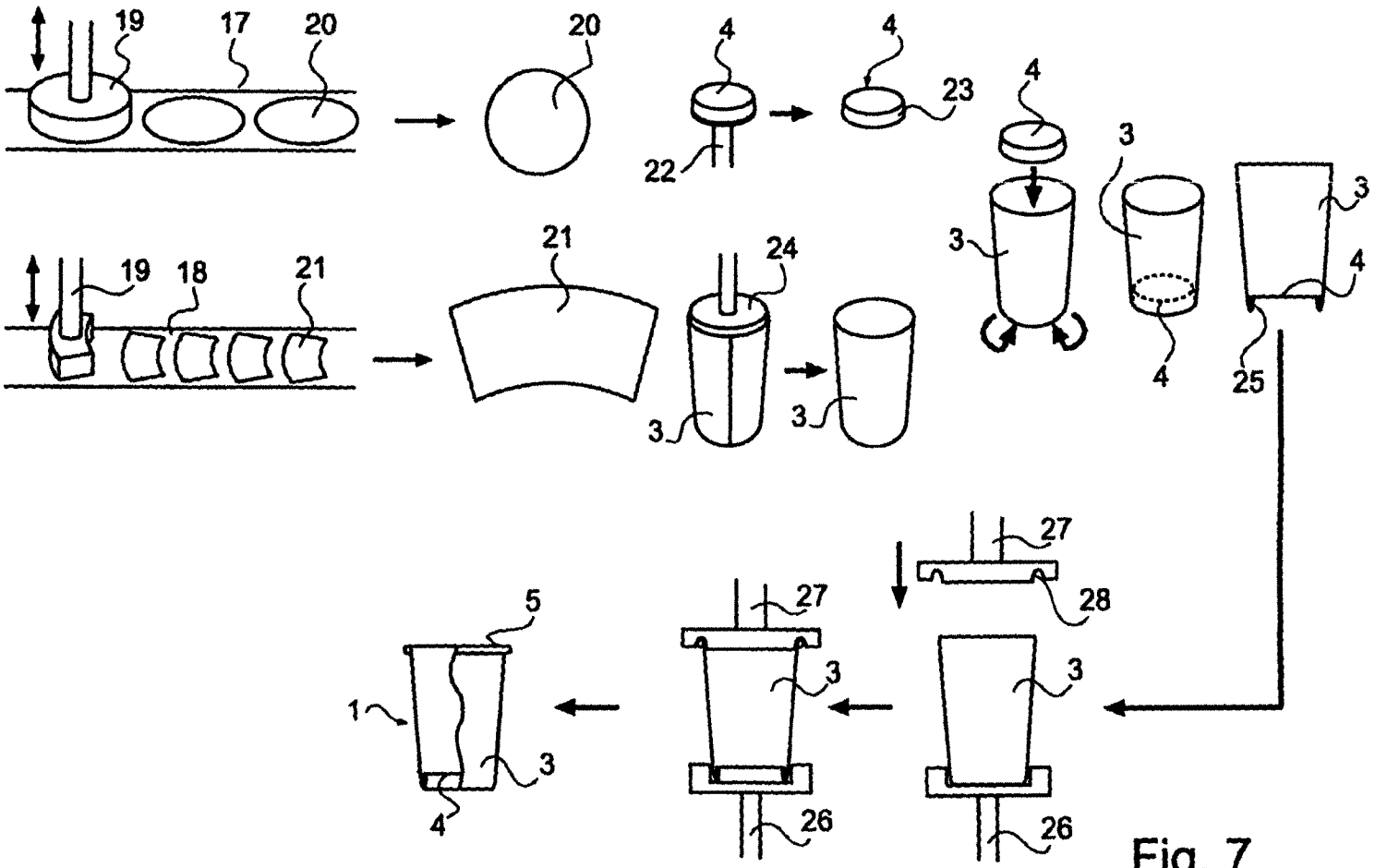

The invention is explained in greater detail below by means of examples and with reference to the accompanying drawings, in which FIG. 1 shows a cup package of the invention having a cup and a lid, with the parts separated, FIG. 2 is a partial cross-sectional view of the package of FIG. 1 in the form of a product package closed with a lid, FIGS. 3 and 4 show, similarly as FIGS. 1 and 2, a second application of the invention, comprising a three-part package, in which the lid closes an upper cup, which, in turn, acts as a lid for the lower cup, FIG. 5 is a cross-sectional view of an application of the invention comprising parts of the lower cup and the upper cup acting as a lid for this and having beads for interlocking the cups, FIG. 6 illustrates cup parts of FIG. 5 pressed into nested relationship, and FIG. 7 is a schematic view of the manufacture of the parts of the package of the invention.

FIGS. 1 and 2 show a cup package made entirely from a fibre-based material, such as e.g. a polyethene-coated packaging board, the cup package consisting of a cup 1 and a lid 2 closing its mouth. The cup 1 corresponds to a conventional disposable drinking cup made of board, comprising a sealed mantle 3 shaped as a truncated cone, a bottom 4 sealed together with the mantle, and a bead formed in the mantle around the cup mouth, which is a mouth roll 5 moulded mechanically with the aid of heat and moisture. The lid 2, again, comprises a discoid centre 6 and a surrounding sealed frame 7. The frame 7 has an upwardly conically expanding shape corresponding to the mantle 3 of the cup, the cup and the lid being insertable into partially nested relationship as shown in FIG. 2. Like the cup 1, the lid 2 is also equipped with a mouth roll 8 formed at the edge of the frame.

In the closed package of FIG. 2, the outer side of the frame 7 of the lid 2 bears against the inner surface of the mantle 3 of the cup 1, their mutual compression and friction retaining the lid in position at the mouth of the cup. The mouth rolls 5, 8 of the cup and the lid are disposed on the outer side of the package as adjacent rings encircling the package. The mouth rolls 5, 8 act as stiffeners of the cup and the lid, and especially the mouth roll 8 acts as a stop, which the user can grip with his/her fingers when opening the lid. Similarly, the user easily pushes the lid 2 into position by pressing the mouth roll 8 while closing the package.

The package described above can constitute a product package marketed for consumers, in which the cup contains the packaged product 9 and is closed by the lid 2. The package is suitable especially for sweets and dry snack products, but also e.g. for ready-made foods, jams, marmalades and desserts with adequately firm consistence. In addition, the package of the invention can be used e.g. as a drinking cup or a receptacle for sweets or similar dry snack products, which need to be temporarily closed with a lid after the drink has been poured or the product dispensed.

The three-part cup package illustrated in FIGS. 3 and 4 is formed of a lower cup 1, an upper cup 10 partially nested in this and serving as a lid for the lower cup, and a lid 2 closing the upper cup and partially nested in this. The nested mantle or frame parts 3, 11, 7 of the parts 1, 10, 2 have been given a conically upwardly expanding shape and each part comprises a discoid bottom 4, 12 or a centre 6 surrounded by the mantle 3, 11 or frame 7. The parts 1, 10, 2 can be manufactured by the same techniques on principle, and each of them has been provided with a mouth roll 5, 13, 8 encircling the mouth or edge of the part.

A three-part package closed as in FIG. 4 may form a product package, in which the product 9 contained in the lower cup 1 and the product 14 contained in the upper cup 10 of smaller height differ from each other in quantity and quality. The main product 5, present in a larger amount, may be e.g. a ready-made food, a snack or a dessert, and the product 14 contained in the upper cup 10 can consist of trimmings to be combined with the main product, such as e.g. seasoning or dressing. The mouth rolls 5, 13 8 disposed adjacent each other on the sides of the package enable all of the three parts 1, 10, 2 to be detached from each other, or, if desired, the lower cup 1 to be opened by detaching the upper cup 10 from this, the upper cup remaining closed by the lid 2, or the upper cup 10 to be opened without detaching it from the lower cup 1, which thus remains sealed.

FIGS. 5 and 6 give examples of beads and recesses formed if necessary in the nested parts 1, 10 of the package in order to enhance the attachment between the parts. An annular bead has been moulded in the mantle 3 of the lower cup 1, in the vicinity of the mouth roll 5 forming its upper edge, the bead being visible as an annular recess 15 in the inner surface of the mantle. Protruding nodules 16 have been similarly moulded on the outer surface of the mantle 11 of the upper cup 10 of lower height, these nodules engaging said annular recess 15 when the cups are pushed into nested relationship, cf. FIG. 6. The detailed embodiment of such a design for enhancing the attachment between the parts may vary, and they can be provided also between the upper cup 10 and its closing lid (not illustrated in FIGS. 5 and 6) or in a two-part package.

FIG. 7 shows step by step a process for manufacturing the cup package of the invention. The figure relates to the manufacture of a cup 1 for receiving a product to be packaged or a main product, however, the manufacture of the other parts of the package, i.e. the lid and any lower cups, is performed in the same manner on principle.

The package material may be a package board whose one or both faces are extrusion-coated with polyethene, for instance. Bottom blanks 20 and mantle blanks 21 are cut by punches 19 from board webs 17, 18. A border 23 surrounding the bottom 4 is moulded in each bottom blank 20 with a compression-moulding press 22. The mantle blanks 21 are wound about a conical moulding tool 24 and are sealed by means of coating plastic to form mantle parts 3 having the shape of a truncated cone. If the board is plastic-coated on the one side alone, the coating forms the upper surface of the moulded bottom 4 and the inner surface of the seamed mantle 3. Next, the bottom 4 and the mantle 3 are fitted together and the lower edge 25 of the mantle is bent and sealed by heat-sealable coating plastic against the border 23 moulded in the bottom. The seals provide a liquid-proof cup. Finally, a mouth roll is formed in the cup by placing the cup on a stationary substrate 26 and by moulding vertically by means of a reciprocating striking tool 27. The heatable tool 27 comprises an annular groove 28, which hits the upper edge of the cup mantle 3, forcing this to be bent outwardly and downwardly and to be rolled so as to form a protruding bead on the mantle mouth. This work step requires the mouldable location of the board to be softened by moisturising, for instance, in order to achieve a permanent bead, i.e. mouth roll 5.

The manufacture of the upper cup 10 of lower height in a three-part package illustrated in FIGS. 3 and 4 may be performed as described above in connection with FIG. 7. The sole difference from FIG. 7 is the design of the mantle blank 21 resulting in the lower cup. The manufacture of the lid 2 of the package may be performed with similar operations, except that the lid frame 7 corresponding to the cup mantle is narrower than above.

It is obvious to those skilled in the art that the embodiments of the invention are not restricted to the examples given above, but may vary within the scope of the following examples. Thus, instead of extrusion-coated board, the package material may be dispersion-coated board, the chemical providing the liquid proofness of the board being e.g.

styrene acrylate, polyvinyl acetate (PVAC) or any fluorine chemical. The package can also be manufactured in accordance with the description above from a board that has not been plastic coated, and the inner surfaces of the cup and the lid can be subsequently treated by spraying an applicable coating providing liquid proofness, such as paraffin or wax. In packages for sweets or similar dry products, it is also possible to use a material that has no plastic-coating at all.

The invention claimed is:

1. A cup package made of a bendable fibre-based packaging board and comprising a cup of said board for a product to be packaged and a lid of said board for closing the mouth of the cup, the cup comprising a discoid bottom and a surrounding mantle, the discoid bottom having a moulded circumferential downward rim and the mantle having an upwardly bent lower edge sealed against said circumferential rim of the discoid bottom and the lid comprising a discoid centre and a surrounding frame, the discoid centre having a moulded circumferential downward rim and the frame having an upwardly bent lower edge sealed against said circumferential rim of the discoid centre, the mantle of the cup and the frame of the lid expanding conically upwards, and the lid being in partially nested relationship with the cup, the attachment of the lid to the cup being based upon friction and compression between the mantle of the cup and the frame of the lid, the cup package being openable by lifting the lid off the cup by fingers and closable by pressing the lid on the cup, and vertically adjacent stiffening mouth rolls are provided at the mouth of the cup and the edge of the lid, with the lid mouth roll disposed above the cup mouth roll, said mouth rolls extending radially outwardly and acting as grip bases when the lid is opened, wherein the discoid centre and the surrounding frame of the lid are separately obtained from bendable fibre-based packaging boards and the discoid centre and the surrounding frame of the lid are sealed to each other to form the lid.

2. The cup package as defined in claim 1, wherein the mantle of the cup and the lid are positioned in opposing, engaging relationship with respect to each other.

3. The cup package as defined in claim 1 or 2, wherein friction and/or compression between the inner surface of the cup and the lid retains the lid in position.

4. The cup package as defined in claim 1 or 2, wherein at least one of the opposing surfaces of the cup and the lid comprises one or more protrusions in order to provide attachment between the respective surfaces.

5. The cup package as defined in claim 4, wherein one of the opposing surfaces of the cup and the lid comprises one or more protrusions, the other one comprising one or more recesses for receiving the protrusions in order to provide attachment between the respective surfaces.

6. The cup package as defined in claim 1, wherein the frame of the lid has the mouth roll at its edge.

7. The cup package as defined in claim 1, wherein said package has at least three parts comprising, a lowermost, large-sized cup, a smaller-sized cup disposed in said large-sized cup in a partially nested relationship and an uppermost lid, each of said parts containing mouth rolls which are vertically adjacent to each other, acting as grip bases when the parts are separated.

8. The cup package as defined in claim 7, which is a food package, wherein the large-sized cup contains a main product and the smaller-sized cup contains trimmings.

9. The cup package as defined in claim 1, wherein the cup and the lid are made of polymer-coated board, with the polymer coating provided on at least the inner surfaces of the cup and the lid.

10. The cup package as defined in claim 1, wherein the package has at least three parts comprising, a lowermost cup, an upper cup in partially nested relationship with the lowermost cup and an uppermost lid, each of said parts containing vertically adjacent mouth rolls disposed above each other and acting as grip bases when the parts are separated.

11. The cup package of claim 1 further comprising an upper cup disposed between the lid and the cup and partially nested within the cup, said upper cup having a mouth roll which is vertically adjacent and disposed between the mouth rolls of the lid and the cup, with the respective mouth rolls being disposed above and below each other.

12. The cup package of claim 1, wherein the fibre-based material for the cup package is packaging board.

13. The cup package of claim 1, wherein the fibre-based material can be selectively provided with a plastic, wax or liquid proof coating.

14. The cup package of claim 1, wherein the discoid bottom and the surrounding mantle of the cup are separately obtained from bendable fibre-based packaging boards and the discoid bottom and the surrounding mantle of the cup are sealed to each other to form the cup.

15. A method for manufacturing a cup package with a lid as defined in claim 1, wherein a board cup is formed by sealing a principally discoid bottom with a mantle forming the sides of the cup and by equipping the mouth of the cup with a surrounding mouth roll, and that a board lid is formed for closing the mouth of the cup by sealing a principally discoid centre with a sleeve-like frame partially nested in the cup mantle and by equipping the edge of the frame with a surrounding mouth roll, the cup and the lid being substantially manufactured by mutually corresponding operations and the mouth rolls formed in the cup and the lid are vertically adjacent each other with the lid mouth roll disposed above the cup mouth roll in the closed package.

16. The method as defined in claim 15, wherein the mouth rolls are formed in the cup and the lid by mechanical moulding of a fibre-based packaging material.

17. The method as defined in claim 15, wherein the product package further comprises an upper cup containing a mouth roll wherein the product package is manufactured by nesting the cups together and closing the mouth of the uppermost cup with the lid, whereby the respective mouth rolls are dispose above and below each other.

18. The method of claim 15, wherein the cup package is packaging board.

* * * * *